US008656994B2

(12) United States Patent
Shako et al.

(10) Patent No.: US 8,656,994 B2
(45) Date of Patent: Feb. 25, 2014

(54) METHOD FOR DETERMINATION OF FLUID INFLUX PROFILE AND NEAR-WELLBORE AREA PARAMETERS

(75) Inventors: Valery Vasilievich Shako, Domodedovo (RU); Vyacheslav Pavlovich Pimenov, Moscow (RU); Fikri John Kuchuk, Clamart (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 13/248,688

(22) Filed: Sep. 29, 2011

(65) Prior Publication Data

US 2012/0103601 A1 May 3, 2012

(30) Foreign Application Priority Data

Sep. 30, 2010 (RU) ..... 2010139993

(51) Int. Cl.
*E21B 47/00* (2012.01)

(52) U.S. Cl.
USPC ..... 166/250.02; 166/336

(58) Field of Classification Search
USPC ..... 166/336, 250.02; 175/72, 217, 25, 48, 175/50
See application file for complete search history.

(56) References Cited

U.S. PATENT DOCUMENTS

| | | | |
|---|---|---|---|
| 5,574,218 | A | 11/1996 | Withers |
| 6,985,816 | B2 | 1/2006 | Sorrells et al. |
| 2012/0305242 | A1 | 12/2012 | Charara et al. |

FOREIGN PATENT DOCUMENTS

| | | | |
|---|---|---|---|
| EA | 005350 | | 2/2005 |
| EP | 0176410 | A1 | 4/1986 |
| EP | 2065556 | A1 | 6/2009 |
| GB | 2451560 | A1 | 2/2009 |
| GB | 2466438 | | 6/2010 |
| RU | 2143064 | | 12/1999 |
| RU | 2290507 | | 12/2006 |
| RU | 2301886 | | 6/2007 |
| RU | 2370791 | | 10/2009 |
| RU | 2394985 | | 7/2010 |
| WO | 9623957 | | 8/1996 |
| WO | 9904292 | | 1/1999 |
| WO | 2005035943 | A1 | 4/2005 |

OTHER PUBLICATIONS

Search Report of GB Application Serial No. 1117050.3 (18.0134GB) dated Nov. 23, 2011.

Chekaluyk, "Oil Stratum Thermodynamics," NEDRA Publishing: Moscow, 1965: p. 67.

Cheremensy, "Applied Geothermics," NEDRA Publishing: Lenngrad, 1977: pp. 181-182.

*Primary Examiner* — Brad Harcourt
*Assistant Examiner* — Taras P Bemko

(57) ABSTRACT

Method for determination of a fluid influx profile and near-wellbore area parameters comprises measuring a first bottomhole pressure and after operating a well at a constant production rate changing the production rate and measuring a second bottomhole pressure. A wellbore fluid temperature over an upper boundary of a lowest productive layer and wellbore fluid temperatures above and below other productive layers are measured and relative production rates and skin factors of the productive layers are calculated from measured wellbore fluid temperatures and measured first and second bottomhole pressures.

3 Claims, 5 Drawing Sheets

METHOD FOR DETERMINATION OF FLUID INFLUX PROFILE AND NEAR-WELLBORE AREA PARAMETERS

FIELD OF THE DISCLOSURE

The invention relates to the area of geophysical studies of oil and gas wells, particularly, to the determination of the fluid influx profile and multi-layered reservoir near-wellbore area parameters.

BACKGROUND OF THE DISCLOSURE

A method to determine relative production rates of the productive layers using quasi-steady flux temperature values measured along the wellbore is described, e.g., in: Čeremenskij G. A. Prikladnaja geotermija, Nedra, 1977 p. 181. A disadvantage of this method is a low accuracy of the layers' relative flow rate determination resulting from the assumption of the Joule-Thomson effect constant value for different layers. In effect, it depends on the formation pressure and specific layer pressure values.

SUMMARY OF THE DISCLOSURE

The technical result of the invention is an increased accuracy of the wellbore parameters (influx profile, values of skin factors for different productive layers) determination.

The claimed method comprises the following steps. A first bottomhole pressure is measured; after an operation of a wellbore at a constant production rate the production rate is changed. Then a second bottomhole pressure and a wellbore fluid temperature over an upper boundary of a lowest productive layer as well as wellbore fluid temperatures above and below other productive layers are measured. A first graph of the wellbore fluid temperature measured over the upper boundary of the lowest productive layer as a function of time and a second graph of a derivative of the wellbore fluid temperature with respect to a logarithm of a time passed after the production rate has been changed as a function of time are plotted. A time at which the derivative of the wellbore fluid temperature becomes constant is determined from the second plotted graph. A wellbore fluid temperature change corresponding to the time at which the derivative of the wellbore fluid temperature becomes constant is determined from the first plotted graph. A skin factor and a relative production rate of the lowest productive layer are determined using the determined values. Relative production rates and skin factors of the overlying layers are calculated by iterative procedure using the wellbore fluid temperatures measured above and below other productive layers and measured first and second bottomhole pressures.

The total number of layers n in the method claimed is not limited. Particular distance from the temperature transmitters to the layers' boundaries shall be determined depending on a casing string diameter and wellbore production rate. In most cases the optimum distance is 1-2 meters. Processing of the data obtained using the method claimed in the invention enables finding production rates and skin factors of separate layers in the multi-layer wellbore.

DETAILED DESCRIPTION

Figure 1:
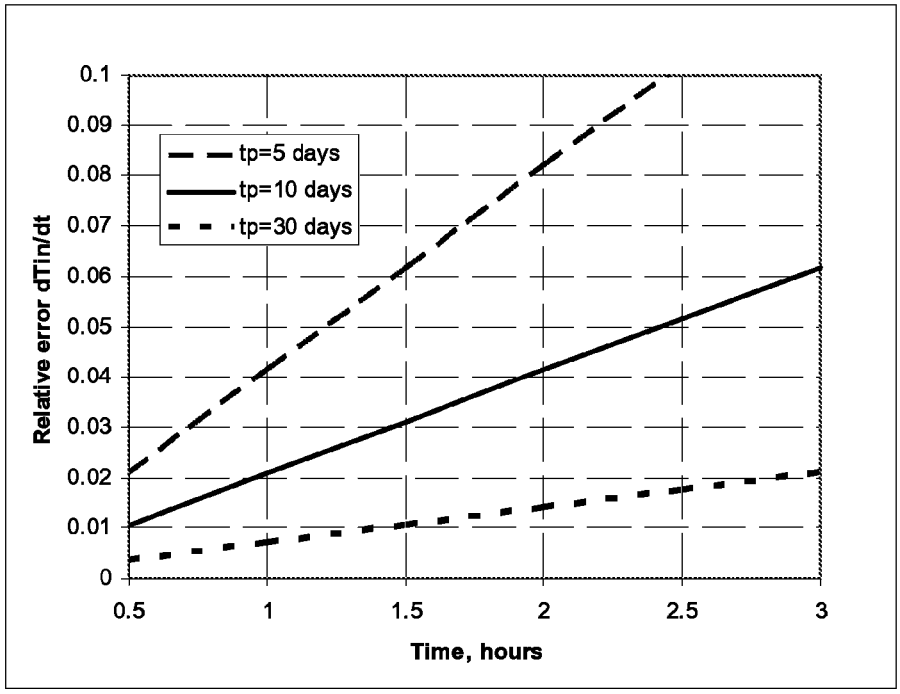
FIG. 1 shows the influence of the production time on the temperature change rate after the wellbore production rate has been changed.

The claimed method is based on a simplified model of heat- and mass-exchange processes in a productive layer and a wellbore. Let us consider the results of the model application for the processing of measurement results of temperature $T_{in}^{(i)}(t)$ of fluids flowing into the wellbore from two productive layers.

In the approximation of fast pressure stabilization in the productive layers, the rate of change in the temperature of a fluid flowing into the wellbore after the production rate has changed is described by Equation (1):

$$\frac{dT_{in}}{dt} = \frac{\varepsilon_0}{2\cdot(s+\theta)}\cdot\left[\frac{P_e-P_1}{f(t,t_{d1})}\cdot\frac{1}{(\delta_{12}\cdot t_p+t_2+t)}+\frac{P_1-P_2}{f(t,t_{d2})}\cdot\frac{1}{(t_2+t)}\right], \quad (1)$$

where $\epsilon_0$—Joule-Thomson coefficient, $P_e$ is a layer pressure, $P_1$ and $P_2$—a first bottomhole pressure before and a second bottomhole pressure after the production rate has changed, s—a skin factor of a productive layer, $\theta=\ln(r_e/r_w)$, $r_e$—a drain radius, $r_w$—a wellbore radius, t—time passed from the moment when the production rate has changed, $t_p$—a production time at the first bottomhole pressure $$P_1,\ \delta_{12} = \frac{P_e-P_1}{P_e-P_2}, \quad (2)$$

$$f(t,t_d) = \begin{cases} K & t \le t_d \\ 1 & t_d < t, \end{cases}$$

$$K = \frac{k_d}{k} = \left[1+\frac{s}{\theta_d}\right]^{-1}$$

—a relative permeability of a near-wellbore zone, $\theta_d=\ln(r_d/r_w)$, $r_d$—an external radius of the near-wellbore zone with the permeability and fluid influx profile changed as compared with the properties of the layer far away from the wellbore which is determined by a set of factors, like perforation hole properties, permeability distribution in the affected zone around the wellbore and drilling incompleteness, $t_{d1}=t_1\cdot D$ and $t_{d2}=t_2\cdot D$—certain characteristic heat-exchange times in a layer 1 and a layer 2, $D=(r_d/r_w)^2-1$—a non-dimensional parameter characterizing a size of the near-wellbore area, $$t_{1,2} = \frac{\pi\cdot r_w^2}{\chi\cdot q_{1,2}}$$

characteristic times determined by specific production rates $q_1$ and $q_2$ before and after the production rate has changed, $$q_{1,2} = \frac{Q_{1,2}}{h} = \frac{2\pi \cdot k}{\mu} \cdot \frac{(P_e - P_{1,2})}{s + \theta}$$

—specific volumetric production rates before and after the production rate has changed, $Q_{1,2}$—volumetric production rates before and after the production rate has changed, h and k—a thickness and permeability of a layer, $$\chi = \frac{c_f \cdot \rho_f}{\rho_r \cdot c_r},$$

$$\rho_r c_r = \phi \cdot \rho_f c_f + (1 - \phi) \cdot \rho_m c_m,$$

$\phi$ is a layer's porosity, $\rho_f c_f$—volumetric heat capacity of the fluid, $\rho_m c_m$—volumetric heat capacity of a rock matrix, $\mu$—the fluid viscosity.

According to Equation (1) if a relatively long production time $t_p$ passes before the production rate has changed its influence on the temperature change dynamics tends towards zero. Let us quantify this influence. For the order of magnitude $\chi \approx 0.7$, $r_w \approx 0.1$ m, and for $r_d \approx 0.3$ m q=100[$m^3$/day]/3 m≈$4 \cdot 10^{-4}$ $m^3$/s we have: $t_2 \approx 0.03$ hours, $t_{d2} \approx 0.25$ hours. If the measurement time t is t≈2÷3 hours (i.e. $t \gg t_2, t_{d2}$ and $f(t, t_{d2}) = 1$) it is possible to evaluate what relative error is introduced into the derivative (1) value by the final production time before the measurements:

$$\frac{1}{\dot{T}_{in}} \cdot \Delta(\dot{T}_{in}) = \frac{P_e - P_1}{P_1 - P_2} \cdot \frac{1}{1 + \frac{t_p}{t}} \tag{3}$$

FIG. 1 shows the calculation results using Equation (3) for $P_e$=100 Bar, $P_1$=50 Bar, $P_2$=40 Bar and $t_p$=5, 10 and 30 days. From the Figure we can see, for example, that if the time of production at a constant production rate was 10 or more days, then within the time t=3 hours after the production rate has changed the influence of $t_p$ value on the influx temperature change rate will not exceed 6%. It is essential that an increase in the measurement time t results in a proportional increase in the required production time at the constant production rate before the measurements, so that the error introduced into the derivative (1) by the value $t_p$ can be maintained unchanged.

Then it is assumed that the production time $t_p$ is long enough and Equation (1) may be written as:

$$\frac{dT_{in}}{dt} \approx \frac{\varepsilon_0 \cdot (P_1 - P_2)}{2 \cdot (s + \theta)} \cdot \frac{1}{f(t, t_d)} \cdot \frac{1}{t} \tag{4}$$

From Equation (4) it is seen that at long enough time values $t > t_d$, where $$t_d = \frac{\pi \cdot r_w^2 \cdot D}{\chi \cdot q} \tag{5}$$

the temperature change rate as a function of time is described as a simple proportion:

$$\frac{dT_{in}}{d\ln t} = const.$$

Numerical modeling of the heat- and mass-exchange processes in the productive layers and the production wellbore shows that the moment $t = t_d$ may be marked on a graph of $$\frac{dT_{in}}{d\ln t}$$

vs. time as the start of the logarithmic derivative constant value section.

Assuming that the dimensions of the bottomhole areas in different layers are approximately equal ($D_1 \approx D_2$), then using times $t_d^{(1)}$ and $t_d^{(2)}$, found for two different layers their relative production rates may be found using Equation (6).

$$Y = \frac{q_2 h_2}{q_1 h_1 + q_2 h_2}$$

or $$Y = \left(1 + \frac{q_1 \cdot h_1}{q_2 \cdot h_2}\right)^{-1} = \left(1 + \frac{h_1}{t_d^{(1)}} \cdot \frac{t_d^{(2)}}{h_2}\right)^{-1}$$

In general relative production rates of the second, third, etc., layers are calculated using Equation (6):

$$Y_2 = \frac{q_2 h_2}{q_1 h_1 + q_2 h_2} = \left[1 + \left(\frac{h_1}{t_d^{(1)}}\right) \cdot \frac{t_{d,2}}{h_2}\right]^{-1}, \tag{6}$$

$$Y_3 = \frac{q_3 h_3}{q_1 h_1 + q_2 h_2 + q_3 h_3} = \left[1 + \left(\frac{h_1}{t_d^{(1)}} + \frac{h_2}{t_d^{(2)}}\right) \cdot \frac{t_d^{(3)}}{h_3}\right]^{-1},$$

$$Y_4 = \frac{q_4 h_4}{q_1 h_1 + q_2 h_2 + q_3 h_3 + q_4 h_4} = \left[1 + \left(\frac{h_1}{t_d^{(1)}} + \frac{h_2}{t_d^{(2)}} + \frac{h_3}{t_d^{(3)}}\right) \cdot \frac{t_d^{(4)}}{h_4}\right]^{-1},$$

etc.

Equation (1) is obtained for a cylindrically symmetrical flow in a layer and a near-wellbore area which has an external radius $r_d$. The temperature distribution nature in the near-wellbore area is different from the temperature distribution away from the wellbore. After the production rate has changed this temperature distribution is carried over into the well by the fluid flow which results in the fact that the nature of $T_{in}(t)$ dependence at short times (after the flow rate has changed) differs from $T_{in}(t)$ dependence observed at large ($t > t_d$) time values. From Equation (7) it is seen that with the accuracy to $\chi$ coefficient the volume of the fluid produced required for the transition to the new nature of the dependence of the incoming fluid temperature $T_{in}(t)$ vs, time is determined by the volume of the near-wellbore area:

$$t_d \cdot q_2 = \frac{1}{\chi} \cdot \pi \cdot (r_d^2 - r_w^2) \tag{7}$$

In case of a perforated wellbore there always is a "near-wellbore" area (regardless of the distribution of the permeabilities) in which the temperature distribution nature is different from the temperature distribution in a layer away from the wellbore. This is the area where the fluid flow is not symmetrical and a size of this area is determined by a length of perforation tunnels ($L_p$):

$$D_p \approx \left(\frac{r_w + L_p}{r_w}\right)^2 - 1. \tag{8}$$

Assuming that the lengths of the perforation tunnels in different productive layers are approximately equal ($D_{p1} \approx D_{p2}$), then relative production rates of the layers are also determined by Equation (6). Equation (8) may be updated by introducing a numerical coefficient of about 1.5-2.0, the value of which may be determined from the comparison with the numerical calculations or field data.

Temperature change $\Delta T_d$ of the fluid flowing into the wellbore during a time period between the beginning of flow rate change and time $t_d$ (Equation 9) is used to determine a skin factor s of a productive layer:

$$\Delta T_d = \int_0^{t_d} \frac{dT_{in}}{dt} \cdot dt. \tag{9}$$

Using Equation (4) we find:

$$\Delta T_d = c \cdot \varepsilon_0 \cdot (P_1 - P_2) \cdot \frac{s + \theta_d}{s + \theta}, \tag{10}$$

where $\Delta T_d$ is the change of the influx temperature by the time $t = t_d$, $(P_1 - P_2)$—difference between the first and the second bottomhole pressure which is achieved in the wellbore several hours after the wellbore production rate has changed. Whereas Equation (4) does not consider the influence of the end layer pressure field tuning rate, Equation (10) includes non-dimensional coefficient c (approximately equal to one) the value of which is updated by comparing with the numerical modeling results.

According to (10), skin factor s value is calculated using:

$$s = \frac{\psi \cdot \theta - \theta_d}{1 - \psi} \tag{11}$$

$$\text{where } \psi = \frac{\Delta T_d}{c \cdot \varepsilon_0 \cdot (P_1 - P_2)}$$

When it is impossible to directly measure $T_{in}(t)$ (i=1, 2, . . . , n) of the fluids flowing into the wellbore from different layers we suggest using wellbore temperature measurement data and the following wellbore measurement data processing procedure.

A wellbore fluid temperature over an upper boundary of a lowest productive layer as well as wellbore fluid temperatures above and below other productive layers are measured. Particular distance from the temperature transmitters to the layers' boundaries shall be determined depending on a casing string diameter and wellbore production rate. In most cases the optimum distance is 1-2 meters. Temperature $T_0(t)$ measured over the upper boundary of the lower productive layer is (with a good accuracy) equal to the relevant influx temperature, therefore using a rate of $T_0(t)$ change the value of $t_d^{(1)}$ is determined, influx temperature change is determined by the time $\Delta T(t_d^{(1)}) = \Delta T_d^{(1)}$ and using Equation (11) a skin factor $s_1$ of the lower productive layer is determined.

A relative production rate $Y^{(2)}$ ($Y^{(2)} = Q_2/(Q_1+Q_2)$) and a skin factor of a second productive layer is determined using the following iterative procedure. An arbitrary value of $Y^{(2)}$ is specified and using Equation (12):

$$T_{in}^{(2)}(t) = \frac{1}{Y^{(2)}} \cdot [T_2^{(2)}(t) - (1 - Y^{(2)}) \cdot T_1^{(2)}(t)] \tag{12}$$

where $T_1^{(2)}$ and $T_2^{(2)}$—temperatures measured above and below a second productive layer, a first approximation for the temperature of the fluid flowing into the wellbore from the second productive layer is found. Then, $t_d^{(2)}$ is determined from $T_{in}^{(2)}(t)$ and using Equation (6) a new value of relative production rate $Y_n^{(2)}$ is found:

$$Y^{(2)} = \left(1 + \frac{h_1}{t_d^{(1)}} \cdot \frac{t_d^{(2)}}{h_2}\right)^{-1} \tag{13}$$

If this value differs from $Y^{(2)}$, the calculation using Equations (12) and (13) is repeated until these values are equal.

The determined $Y^{(2)}$ value is the relative production rate of the second layer and the respective $t_d^{(2)}$ value—the time of the influx from the bottomhole area for the second layer. Using the value $Y^{(2)}$ from Equation (12) temperature $T_{in}^{(2)}(t)$ of the inflow from the second layer is found and using $T_{in}^{(2)}(t)$ and the determined $t_d^{(2)}$ value $\Delta T_d^{(2)}$ is determined and using Equation (10) skin factor $s_2$ of the second layer is calculated.

Relative production rates $Y^{(i)}$ ($Y^{(i)} = Q_i/(Q_1+Q_2+ \ldots +Q_i)$) and skin factors of the overlying layers (i=2, 3, etc.) are determined subsequently starting from the second (from the bottom) layer using the following iterative procedure:

$$\text{Set } Y^{(i)}, \tag{14}$$

$$\text{calculate}$$

$$T_{in}^{(i)}(t) = \frac{1}{Y^{(i)}} \cdot [T_2^{(i)}(t) - (1 - Y^{(i)}) \cdot T_1^{(i)}(t)]$$

where $T_1^{(i)}$ and $T_2^{(i)}$—temperatures measured above and below an i productive layer.

By the dependence obtained a time $t_d^{(i)}$ of the influx from the bottomhole area is determined and a new value of $Y^{(i)}$ is calculated using one of the equations below (depending on a layer number i), using the values of characteristic times $t_d^{(i)}$, found for the layers below $$i = 2: \tag{15}$$

$$Y^{(2)} = \left[1 + \left(\frac{h_1}{t_d^{(1)}}\right) \cdot \frac{t_d^{(2)}}{h_2}\right]^{-1}$$

$$i = 3:$$

$$Y^{(3)} = \left[1 + \left(\frac{h_1}{t_d^{(1)}} + \frac{h_2}{t_d^{(2)}}\right) \cdot \frac{t_d^{(3)}}{h_3}\right]^{-1}$$

-continued $i = 4$:

$$Y^{(4)} = \left[1 + \left(\frac{h_1}{t_d^{(1)}} + \frac{h_2}{t_d^{(2)}} + \frac{h_3}{t_d^{(3)}}\right) \cdot \frac{t_d^{(4)}}{h_4}\right]^{-1}$$

etc.

Therefore the determination of the influx profile and skin factors of productive layers by thermometry of transient processes comprises the following steps:

1. A first bottomhole pressure is measured, and a well is operated at a constant production rate for a long time, preferably for a time sufficient to provide a minimum influence of a production time on a rate of a subsequent change of temperatures of fluids flowing from production layers into the well (from 5 to 30 days depending on the planned duration and measurement accuracy requirements).

2. The production rate is changed, a second bottomhole pressure and a wellbore fluid temperature $T_0(t)$ in an influx lower area—over an upper boundary of a lowest productive layer, as well as temperature values below and above other productive layers are measured.

3. Dependence of the logarithmic derivative $dT_0/d\ln t$ as a function of time is calculated and from this dependence graph $t_d^{(1)}$ is determined, $\Delta T_d^{(1)}$ value is determined and using Equation (11) a skin factor $s_1$ of the lowest layer is found.

4. Relative production rates and skin factors of overlying layers (from i=2 to i=n) are determined using iterative procedure (14)-(15).

The possibility of determination of the influx profile and skin factors of productive layers using the method claimed was checked on synthetic examples prepared by using a production wellbore numerical simulator which simulates a transient pressure field in a wellbore-layer system, a non-isothermal flow of compressible fluids in a heterogeneous porous medium, mixing of flows in the wellbore and wellbore-layer heat-exchange, etc.

FIG. 2-5 shows the results of the calculation for the following two-layer model:

$k_1$=100 mD, $s_1$=0.5, $h_1$=4 m $k_2$=500 mD, $s_2$=7, $h_2$=6 m

Figure 2:
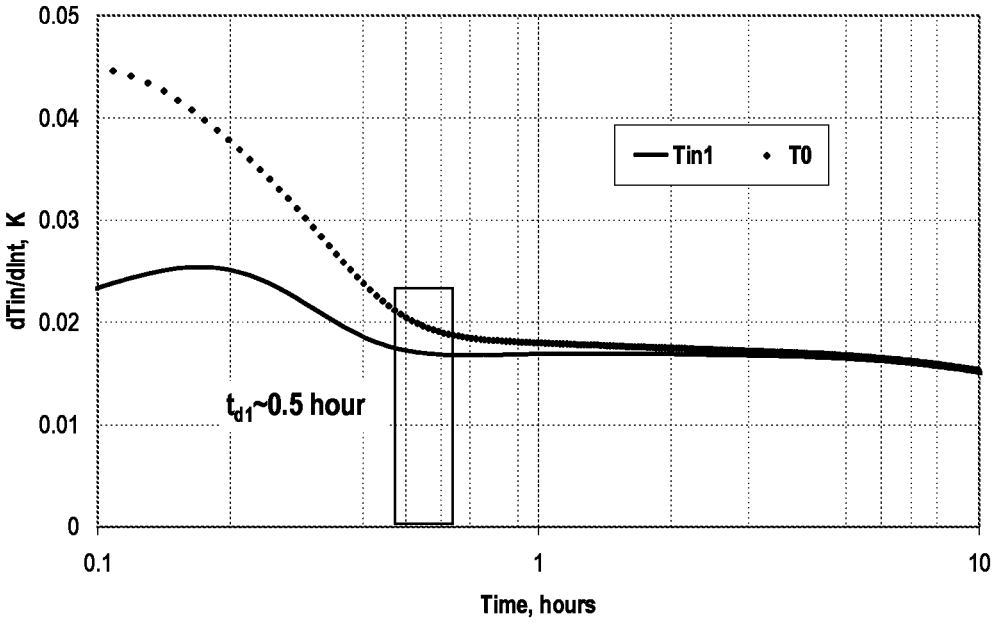
FIG. 2 shows the graphs of the influx temperature derivative $dT_{in1}/dlnt$ and temperature measured over the first productive layer $dT_0/dlnt$ vs. time.
Figure 3:
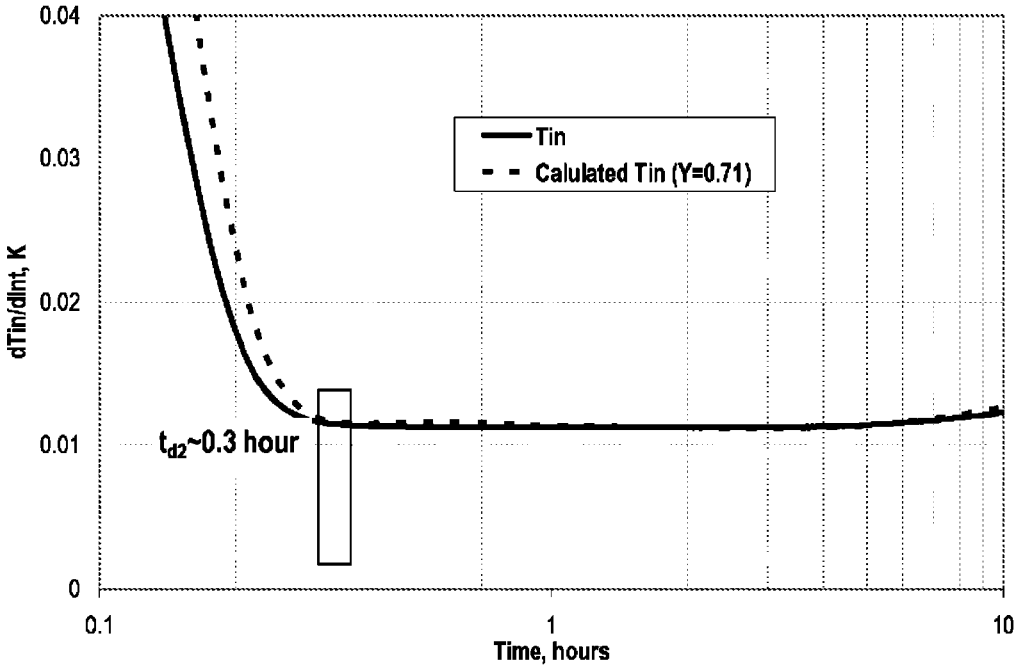
FIG. 3 shows the graphs of the influx temperature derivative $dT_{in2}/dlnt$ and respective temperature calculated using an iterative procedure as a function of time.
Figure 4:
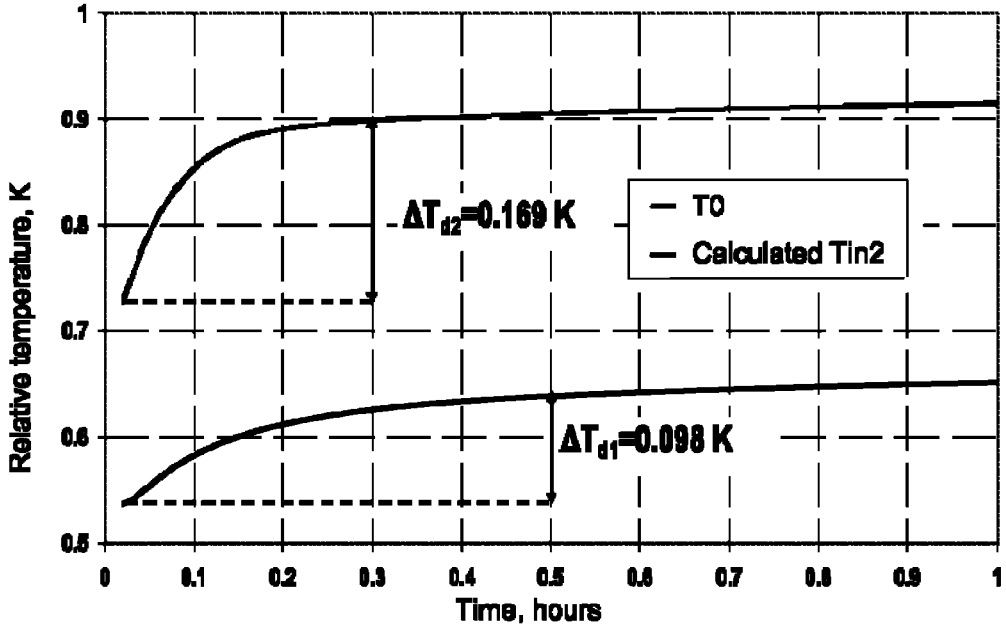
FIG. 4 shows the temperature measured over the first productive layer and temperature of the influx from the second layer calculated using an iterative procedure as well as the determination of changes in influx temperatures $\Delta T_d^{(1)}$ and $\Delta T_d^{(2)}$ (at $t_d^{(1)}$ and $t_d^{(2)}$ time moments) and calculating the layers' skin factors.
Figure 5:
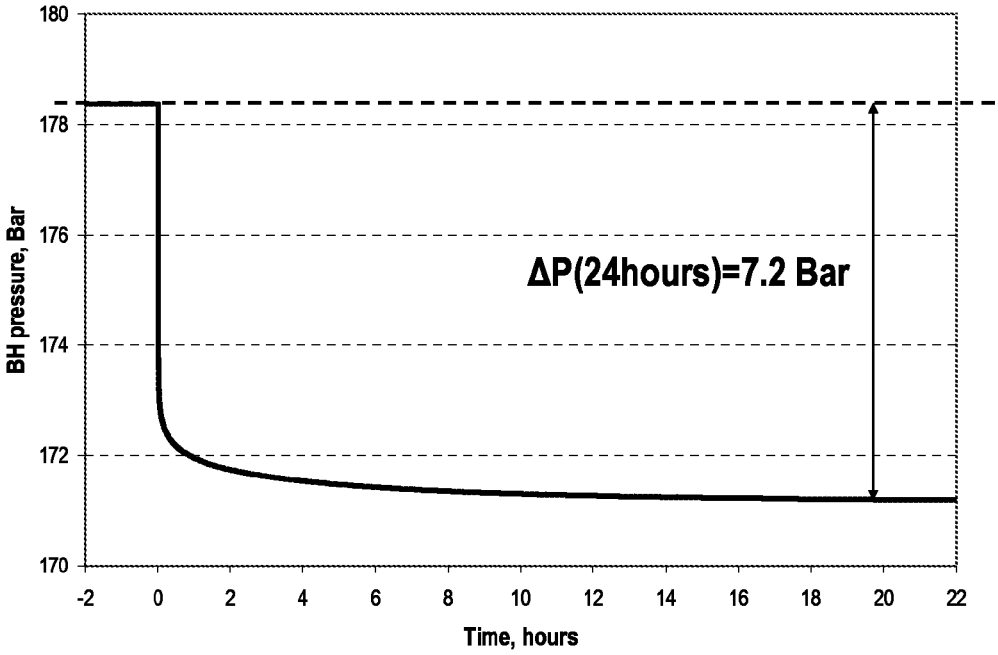
FIG. 5 shows the bottomhole pressure as a function of time passed after the production rate has been changed.

The time of the production at a production rate of $Q_1$=300 $m^3$/day is $t_p$=2000 hours; $Q_2$=400 $m^3$/day. From FIG. 5 it is seen that a wellbore pressure continues to significantly change even after 24 hours. FIG. 2 shows the dependences of the influx temperature $dT_{in1}/d\ln t$ derivative (solid line) and temperature measured over the first productive layer, $dT_0/d\ln t$ (dashed line) as a function of time. FIG. 3 shows the dependences of the influx temperature $dT_{in2}/d\ln t$ derivative (solid line) and respective temperature calculated using iterative procedure (dashed line) as a function of time. From these figures it is seen that temperature $T_0$, and temperature of the influx from the upper layer obtained as a result of the iterative procedure yield the same values of characteristic times as the influx temperatures: $t_d^{(1)}$=0.5 hours and $t_d^{(2)}$=0.3 hours. Using these values a relative production rate of the upper layer is determined as 0.72 which is close to the true value (0.77). FIG. 4 shows a temperature measured over the first productive layer and a temperature of the influx from the second layer calculated using the iterative procedure. By the time moments $t_{d1}$ and $t_{d2}$ the temperature change is: $\Delta T_d^{(1)}$=0.098 K, $\Delta T_d^{(2)}$=0.169 K. If in Equation (11) the non-dimensional constant value of c=1.1, then the layers' skin factors calculated using these values will be different from the true values by a maximum of 20%.

What is claimed is:

1. A method for determination of a fluid influx profile and near-wellbore area parameters comprising:

measuring a first bottomhole pressure in a wellbore, operating the wellbore at a constant production rate, changing the production rate, measuring a second bottomhole pressure after changing the production rate, measuring a wellbore fluid temperature over an upper boundary of a lowest productive layer and wellbore fluid temperatures above and below other productive layers, plotting a first graph of the wellbore fluid temperature measured over the upper boundary of the lowest productive layer as a function of time, plotting a second graph of a derivative of the wellbore fluid temperature with respect to a logarithm of a time passed after the production rate has changed as a function of time, determining from the second plotted graph a time at which the derivative of the wellbore fluid temperature becomes constant, determining from the first plotted graph a wellbore fluid temperature change corresponding to the time at which the derivative of the wellbore fluid temperature becomes constant, calculating a skin factor of the lowest layer as, $$s = \frac{\psi \cdot \theta - \theta_d}{1 - \psi}$$

$$\psi = \frac{\Delta T_d}{c \cdot \varepsilon_0 \cdot (P_1 - P_2)}$$

wherein s is a skin factor of the lowest productive layer, $P_1$ and $P_2$ are a first bottomhole pressure before and a second bottomhole pressure after the production rate has changed, $\epsilon_0$ is Joule-Thomson coefficient, c is a non-dimensional coefficient, $\Delta T_d$ is the wellbore fluid temperature change corresponding to the time at which the derivative of the wellbore fluid temperature becomes constant and determined from the first plotted graph, $\theta_d = \ln(r_d/r_w)$, $r_d$ is an external radius of a near-wellbore zone with an altered permeability and fluid influx profile as compared with properties of a layer far away from the wellbore, $r_w$ is a wellbore radius, $\theta = \ln(r_e/r_w)$, $r_e$ is a drain radius, and determining temperatures of the fluids flowing into the wellbore from overlying layers, relative production rates and skin factors of the overlying layers by an iterative procedure using the determined temperatures of the fluids flowing into the wellbore from overlying layers.

2. A method of claim 1 wherein the wellbore is operated at the constant production rate for a time sufficient to provide a minimum influence of the production time on a rate of a subsequent change of temperature of the fluids flowing from the productive layers into the wellbore.

3. A method of claim 2 wherein the wellbore is operated at the constant production rate from 5 to 30 days before changing the production rate.

* * * * *